US006686695B2

(12) United States Patent
Woo et al.

(10) Patent No.: US 6,686,695 B2
(45) Date of Patent: Feb. 3, 2004

(54) CATHODE RAY TUBE HAVING DEGAUSSING COIL FOR MINIMIZING VARIATIONS IN LANDING OF ELECTRON BEAM

(75) Inventors: Tok-Chin Woo, Suwon (KR); Seong-Seob Kim, Yongin (KR); Jung-Suk Song, Anyang (KR)

(73) Assignee: Samsung SDI Co., Ltd., Suwon (KR)

( * ) Notice: Subject to any disclaimer, the term of this patent is extended or adjusted under 35 U.S.C. 154(b) by 0 days.

(21) Appl. No.: 10/269,472

(22) Filed: Oct. 10, 2002

(65) Prior Publication Data

US 2003/0085658 A1 May 8, 2003

(30) Foreign Application Priority Data

Oct. 16, 2001 (KR) ..... 2001-63808
Jan. 7, 2002 (KR) ..... 2002-0788

(51) Int. Cl.[7] ..... H01J 29/06
(52) U.S. Cl. ..... 315/8; 315/370
(58) Field of Search ..... 315/8, 85, 370; 361/150; 313/313, 402; 317/157.5, 157.5 TV

(56) References Cited

U.S. PATENT DOCUMENTS 3,867,668 A * 2/1975 Shrader ..... 315/8
3,872,347 A * 3/1975 Matsushima et al. ..... 315/8
5,614,791 A * 3/1997 Kume et al. ..... 315/8

FOREIGN PATENT DOCUMENTS

JP 5-260496 10/1993
JP 5-283019 10/1993
JP 6-62419 3/1994
JP 10-210491 8/1998

OTHER PUBLICATIONS

Patent Abstract of Japan, Publication No. 05–260496, Published Oct. 08,1993, in the name of Sony Corp.

Patent Abstract of Japan, Publication No. 05–283019, Published Oct. 29,1993, in the name of Sony Corp.

Patent Abstract of Japan, Publication No. 06–062419, Published Mar. 04,1994, in the name of Sony Corp.

Patent Abstract of Japan, Publication No. 10–210491, Published Aug. 07,1998, in the name of Sony Corp.

* cited by examiner

*Primary Examiner*—Don Wong
*Assistant Examiner*—Jimmy T. Vu
(74) *Attorney, Agent, or Firm*—Christie, Parker & Hale, LLP

(57) ABSTRACT

A cathode ray tube includes a tube having a panel, a funnel, and a neck, a color selection apparatus mounted to the panel within the tube, an inner shield connected to the color selection apparatus. The inner shield includes a plurality of side walls that form a center opening through which electron beams pass, and at least one degaussing coil mounted at outer surface of the tube. The degaussing coil includes a first coil mounted toward the panel, a second coil mounted toward the neck, and a third coil connected to ends of the first coil and the second coil to interconnect the first coil and the second coil. The second coil is mounted on the tube in a state substantially overlapping distal edge portions of the side walls of the inner shield on which the second coil is mounted.

14 Claims, 4 Drawing Sheets

CATHODE RAY TUBE HAVING DEGAUSSING COIL FOR MINIMIZING VARIATIONS IN LANDING OF ELECTRON BEAM

CROSS-REFERENCE TO RELATED APPLICATIONS

This application claims priority of Korean Application Nos. 2001-63808, filed on Oct. 16, 2001 and 2002-788 filed on Jan. 7, 2002 in the Korean Patent Office, the entire contents of which are incorporated herein by reference.

FIELD OF THE INVENTION

The present invention relates to a cathode ray tube, and more particularly, to a cathode ray tube that uses a degaussing coil for demagnetizing metal parts in the cathode ray tube such as a color selection apparatus and an inner shield.

BACKGROUND OF THE INVENTION

Metal parts such as a color selection apparatus and an inner shield are typically found in a cathode ray tube (CRT). The color selection apparatus includes a shadow mask that has a plurality of apertures for performing color separation of three electron beams, which are emitted from an electron gun to corresponding R, G, B phosphors of a phosphor screen, and a mask frame for fixedly supporting the shadow mask at a predetermined location in the CRT. The inner shield performs the function of shielding a path through which the electron beams travel from the earth's magnetic field.

However, the metal parts nevertheless become magnetized by the earth's magnetic field such that a magnetic field is formed in the peripheries of the metal parts. Such a magnetic field changes the paths through which the electron beams travel such that the intended phosphors are not illuminated by the electron beams. That is, mis-landing of the electrons beams occurs, which reduces picture quality.

To remedy this problem, a degaussing coil is mounted on an outer circumference of a funnel of the CRT. The degaussing coil operates for a period of three or four seconds each time the CRT is turned on to demagnetize the color selection apparatus and the inner shield using a demagnetization current.

Japanese Laid-open Patent Nos. Heisei 5-260496, Heisei 5-283019, and Heisei 6-62419 disclose CRTs, in which a pair of degaussing coils is mounted in approximately an M-shape on an outer circumference of a funnel of the CRT. However, when designing the shape and mounting position of the degaussing coils in these conventional CRTs, the formation and positioning of the metal parts (e.g., shadow mask and mask frame) within the CRT, and of an explosion proof band and ears that are mounted toward a panel of the CRT are generally first considered. However, no sufficient consideration is given to the relation with the inner shield, which plays a major part in determining the path of the electron beams.

Japanese Laid-open Patent No. Heisei 10-210491 discloses a CRT, in which a degaussing coil is mounted closer to a front face of a panel than are ears of the CRT. However, when using the CRT with such a configuration in an actual television, computer monitor, etc., the degaussing coil becomes a hindrance when mounting the CRT in an assembly that houses the same, such as a television cabinet. As a result, productivity is reduced during manufacturing of the assembly that houses such CRT.

SUMMARY OF THE INVENTION

In accordance with the present invention a cathode ray tube is provided which uses a degaussing coil capable of sufficiently demagnetizing a color selection apparatus, as well as an inner shield.

Also, in accordance with the present invention, a cathode ray tube is provided which uses a degaussing coil, in which the degaussing coil does not interfere with the mounting of the cathode ray tube in a housing during manufacturing, thereby improving productivity.

In one embodiment, the present invention provides a cathode ray tube including a panel, a funnel, and a neck. The cathode ray tube also includes a color selection apparatus mounted to the panel within the tube; a inner shield connected to the color selection apparatus and including a plurality of side walls that form a center opening through which electron beams pass; at least one degaussing coil mounted an outer surface of the tube. The degaussing coil includes a first coil mounted toward the panel; a second coil mounted toward the neck; and a third coil connected to ends of the first coil and the second coil to interconnect the first coil and the second coil. The second coils is mounted on the tube in a state substantially overlapping distal edge portions of the side walls of the inner shield on which the second coils are mounted.

If a length of the distal edge portions of the side walls of the inner shield on which the second coil is mounted is L1, and a length of the second coils is L2, the following condition is satisfied:

$$L1 \leqq L2.$$

If a distance between the distal edge portions of the side walls of the inner shield on which the second coils are mounted is D1, and a distance between second coils is D2, the following condition is satisfied:

$$0.7 \leqq (D2/D1) \leqq 1.3.$$

The distances D1 and D2 are minimal lengths.

The second coil is are formed along substantially identical horizontal lines as the distal edge portions on which the second coils are mounted.

In one embodiment, the color selection apparatus includes a mask frame including two pairs of support members, the support members of each pair are at a predetermined distance from each other, and a pair of elastic members, each of which extends to interconnect the support members comprising each pair of the same; and a mask having a plurality of apertures, the support members of the mask frame being connected to the mask, and the mask being mounted receiving tension in a direction corresponding to a width of the panel.

An explosion proof band having a plurality of ears is mounted on the skirt of the panel, and the first coils are mounted on the explosion proof band in a state positioned farther from a front face of the panel than the ears.

In another embodiment, an explosion proof band having a plurality of ears is mounted on the skirt of the panel, and the first coils include first sub coils mounted on the skirt at a position farther from a front face of the panel than the explosion proof band; second sub coils mounted on the explosion proof band at a position closer to the front face of the panel than the ears; and third sub coils interconnecting the first sub coils and the second sub coils.

The first coils further include fourth sub coils mounted on the explosion proof band at a position farther from the front face of the panel than the ears; and fifth sub coils interconnecting the fourth sub coils and the first sub coils.

DETAILED DESCRIPTION

Figure 1:
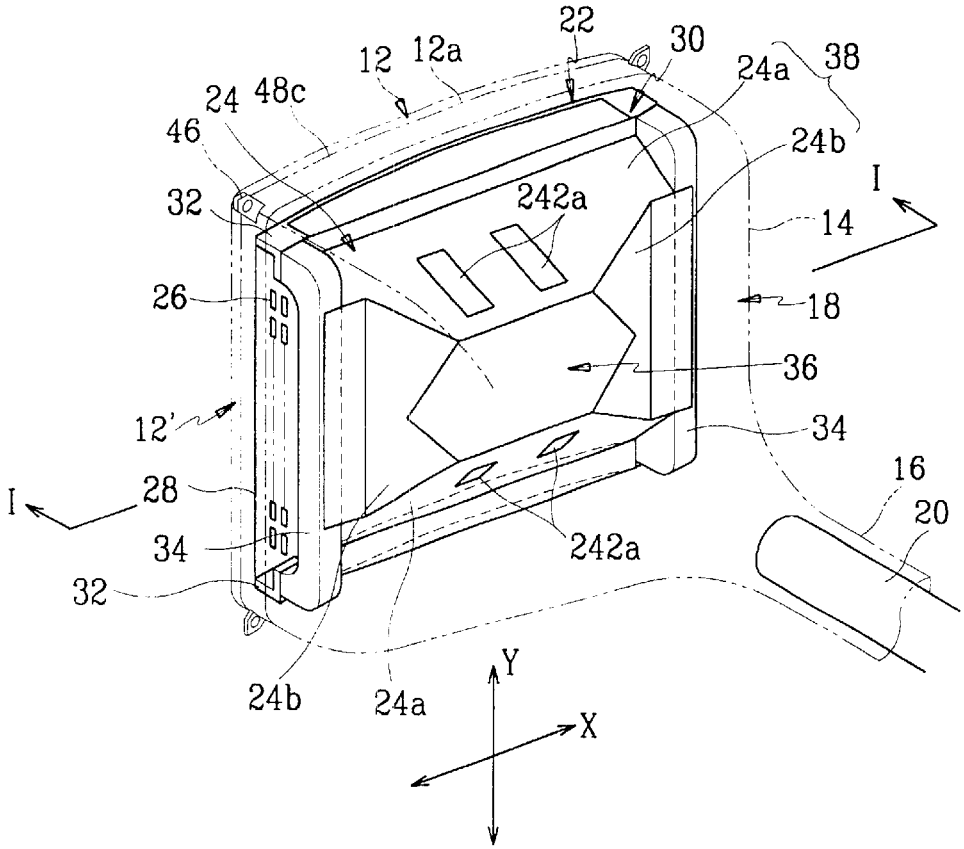
FIG. 1 is a schematic perspective view used to describe an inner structure of a cathode ray tube according to an embodiment of the present invention.
Figure 2:
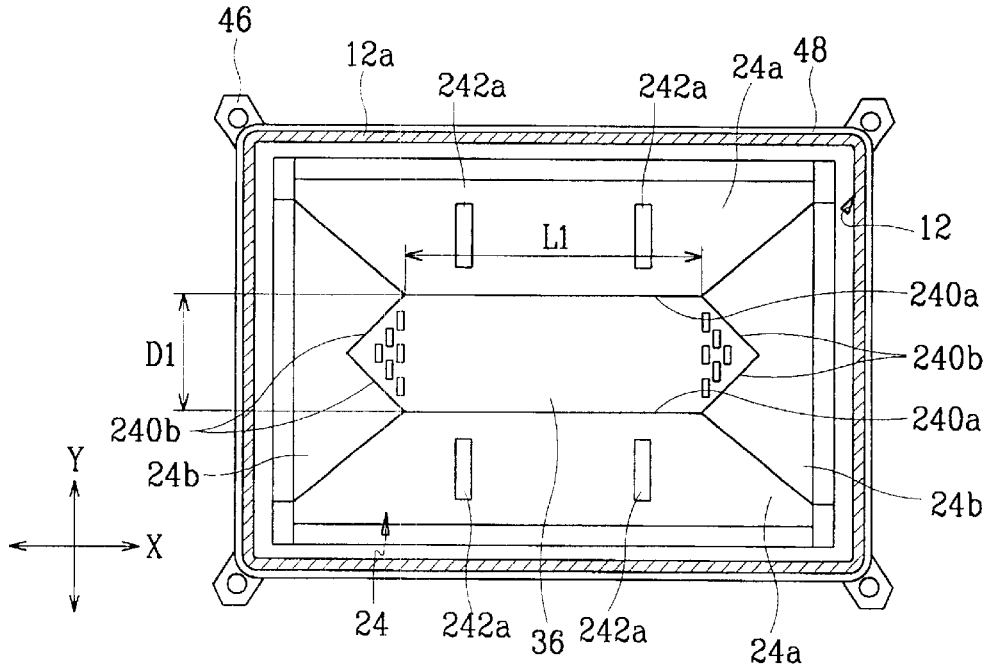
FIG. 2 is a sectional view taken along line I—I of FIG. 1.
Figure 3:
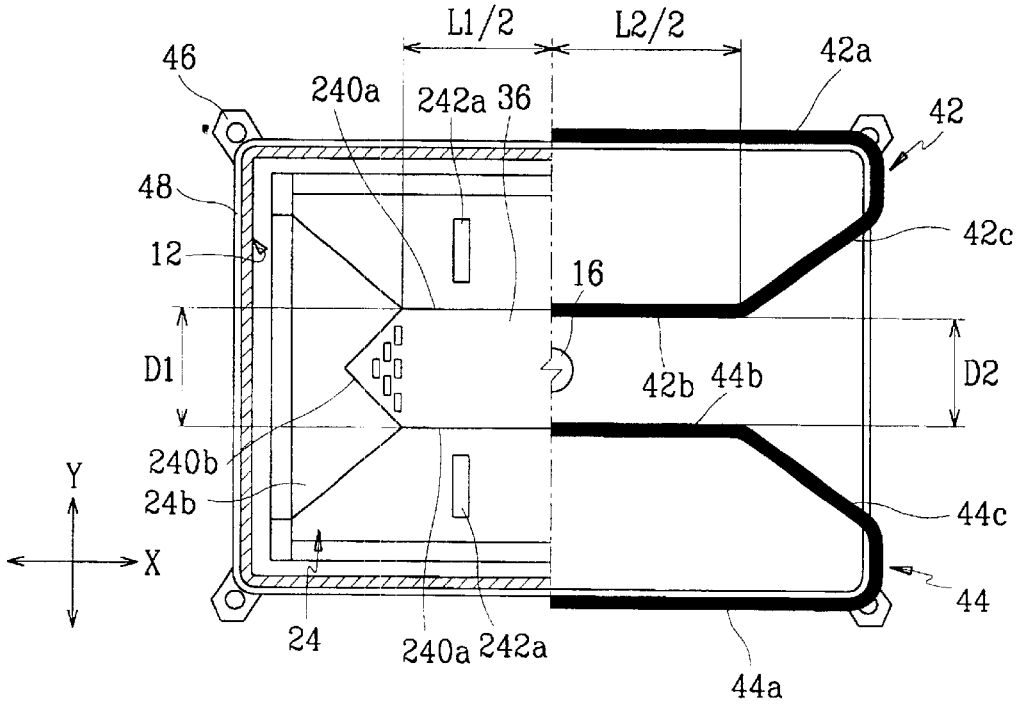
FIG. 3 is a half sectional view of the cathode ray tube of FIG. 1 as seen from the same perspective as FIG. 2.

FIG. 1 is a schematic perspective view used to describe an inner structure of a cathode ray tube according to an embodiment of the present invention, FIG. 2 is a sectional view taken along line I—I of FIG. 1, and FIG. 3 is a half sectional view of the cathode ray tube of FIG. 1 as seen from the same perspective as FIG. 2.

As shown in the drawings, an exterior of a cathode ray tube (CRT) according to a first embodiment of the present invention is defined by a panel 12, a funnel 14, and a neck 16, which are fused into an integral unit to form a tube 18. The tube 18 is evacuated to realize a vacuum state therein of a pressure between $10^{-7}$ and $10^{-10}$ torr.

The panel 12 includes a front face that forms a phosphor screen (not shown) comprised of R, G, B phosphors, and a skirt 12*a* that extends toward the funnel 14 from an outer circumference of the front face of the panel 12. An electron gun 20 is mounted within the neck 16. The electron gun 20 emits electron beams toward the phosphor screen. A deflection unit (not shown) is formed around an outer circumference of the funnel 16, the deflection unit generating an electric field for deflecting the electron beams.

In addition, a color selection apparatus 22 is mounted inwardly from the panel 12. The color selection apparatus 22 separates the R, G, B electron beams emitted from the electron gun 20 to corresponding R, G, B phosphors of the phosphor screen. An inner shield 24 is mounted within the tube 18 in a state connected to the color selection apparatus 22. The inner shield 24 blocks the earth's magnetic field from the path of the electron beams to prevent the misdirection of the electron beams as a result of the influence of the earth's magnetic field.

In one embodiment of the present invention, the color selection apparatus 22 includes a mask 28 having a plurality of apertures 26 and mounted receiving tension in a direction corresponding to a short side of the panel 12, and a mask frame 30 for fixedly supporting the mask 28. The mask frame 30 includes support members 32 connected to the mask 28 at each corner area thereof, and a pair of elastic members 34, each of which extends in direction Y and is connected to the support members 32 on opposite ends of the mask 28.

The color selection apparatus 22 is mounted inwardly from the panel 12 by the demountable connection of a connecting spring (not shown), which is connected to the mask frame 30, to stud pins (not shown). The stud pins are fixed to an inside surface of the skirt 12*a* of the panel 12.

Further, the inner shield 24 is fixed to the mask frame 30 and partly surrounds the path through which the electron beams pass within the funnel. The inner shield 24 comprises a plurality of side walls 38 (typically four), which when combined form a center opening 36.

The center opening 36 is formed by the meeting of distal ends (i.e., non-connected edges) of the side walls 38. That is, the side walls 38 include a pair of long side walls 24*a* mounted to the mask frame 30 extending along direction X and slanted toward a long axis of the CRT; non-connected ends of the long side walls 24*a* forming long edges 240*a;* and a pair of short side walls 24*b* mounted to the mask frame 30 extending along direction Y and slanted toward the long axis of the CRT, wherein non-connected ends of the short side walls 24*b* forming short edges 240*b*. The long edges 240*a* and the short edges 240*b* form the center opening 36.

The long edges 240*a* of the long side walls 24*a* are parallel to each other, that is, they are straight and formed along direction X. In addition, each of the long side walls 24*a* include a pair of slits 242*a*.

Since the color selection apparatus 22 and the inner shield 24 configured as described above are made of metal, they become magnetized by the earth's magnetic field during operation of the CRT. The resulting magnetic fields may affect the path of the electron beams. Therefore, degaussing coils 42 and 44 are mounted on an outer surface of the tube 18 for demagnetizing the color selection apparatus 22 and the inner shield 24.

This embodiment of the present invention includes a pair of degaussing coils (i.e., the degaussing coils 42 and 44 shown in FIG. 3) on the outside of the tube 18. As shown in FIG. 3, the degaussing coils 42 and 44 are separated a predetermined distance from the center opening 36 (shown in FIG. 2) is formed. in the embodiment, the pair of degaussing coils are identical in shape and deposited symmetrically with respect to the neck on the outer surface of the tube.

However, this is just one example of how degaussing coils may be provided in the present invention, and other configurations are also possible. For example, a single, integrally formed degaussing coil may be mounted on the tube 18.

The degaussing coils 42 and 44 include first coils 42*a* and 44*a,* respectively, which are mounted toward the panel 12; second coils 42*b* and 44*b,* respectively, which are mounted toward the neck 16; and third coils 42*c* and 44*c,* respectively, the third coil 42*c* interconnecting the first coil 42*a* and the second coil 42*b,* and the third coil 44*c* interconnecting the first coil 44*a* and the second coil 44*b*. For convenience, only half of the degaussing coils 42 and 44 as shown in FIG. 3 is described.

The second coils 42*b* and 44*b* are formed along the long edges 240*a* of the long side walls 24*a* of the inner shield 24. That is, the second coils 42*b* and 44*b* are formed in a straight pattern along direction X. In one embodiment of the present invention, the second coils 42*b* and 44*b* are formed along identical horizontal lines as the long edges 240*a*.

The degaussing coils 42 and 44 satisfy the following condition:

$$L1 \leqq L2,$$

where L1 is a length of the long edges 240*a* of the inner shield 24 (see FIG. 2), and L2 is a length of the second coils 42*b* and 44*b*.

Since it is found that the greater the length L2 of the second coils 42 and 44 compared to the length L1 of the long edges, the greater the demagnetization range of the degaussing coils 42 and 44, the second coils 42*b* and 44*b* are formed to satisfy the above condition. Hence, an improvement in the effectiveness of demagnetization is ensured with the satisfaction of the above condition.

The degaussing coils 42 and 44 also satisfy the following condition:

$$0.7 \leqq (D2/D1) \leqq 1.3,$$

where D1 is a distance between the long edges 240*a* of the inner shield 24 and D2 is a distance between the second coils 42*b* and 44*b*.

The above relation is derived from data of numerous experiments.

Table 1 below represents variations in the landing of electron beams (i.e., the degree to which the electron beams miss their intended landing position) on the panel 12 of the CRT in a state where the degaussing coils 42 and 44 are mounted as described above in a CRT having a 22-inch screen size. At this time, the degaussing coils 42 and 44 are realized by winding a covered conducting wire having a diameter of 0.6 mm a number of times (90 times. Also, a voltage of 110V is applied to the degaussing coils 42 and 44, and a magnetomotive force of 1,200 AT (ampere turns) is realized.

TABLE 1

| No | D1 (mm) | D2 (mm) | D2/D1 | EW (μm) | NS (μm) | EW + NS (μm) |
|---|---|---|---|---|---|---|
| 1 | 140 | 100 | 0.71 | 9.75 | 15.50 | 25.25 |
| 2 | 140 | 120 | 0.86 | 8.25 | 15.00 | 23.25 |
| 3 | 140 | 140 | 1.00 | 7.75 | 16.00 | 23.75 |
| 4 | 140 | 160 | 1.14 | 8.00 | 16.75 | 24.75 |
| 5 | 140 | 180 | 1.29 | 7.75 | 17.00 | 24.75 |
| 6 | 140 | 200 | 1.43 | 9.00 | 18.50 | 27.50 |
| 7 | 140 | 220 | 1.57 | 10.00 | 17.75 | 27.75 |
| 8 | | | | 9.60 | 20.10 | 29.70 |

In Table 1, the distance D2 between the second coils 42*b* and 44*b* is increased from a reference length (e.g., 100 mm), and the changes in the landing of the electron beams is measured at each varied length of the distance D2 (No. 1~No. 7). As shown in the table, the distance D1 between the long edges 240*a* of the long side walls 24*a* of the inner shield 24 is maintained at 140 mm.

The variations in the landing of the electron beams include variations caused by a north-south horizontal component of the earth's magnetic field that is parallel to a long axis of the CRT, and variations caused by an east-west horizontal component that is perpendicular to the long axis of the CRT. These different variations were measured and recorded. In Table 1, EW refers to landing variations caused by the east-west horizontal component of the earth's magnetic field, NS refers to landing variations caused by the north-south horizontal component of the earth's magnetic field, and EW+NS refers to landing variations caused by the combination of the east-west horizontal component and north-south horizontal component of the earth's magnetic field. In Table 1, Entry no. 8 is a comparative example of an embodiment, in which a conventional CRT utilizing M-shaped degaussing coils as described in the Background of the Invention is used to obtain data for comparison.

Table 2 below represents variations in the landing of electron beams (i.e., the degree to which the electron beams miss their intended landing position) on the panel 12 of the CRT in a state where the degaussing coils 42 and 44 are mounted as described above in a CRT having a 34-inch screen size. At this time, the degaussing coils 42 and 44 are realized by winding a covered insulating wire having a diameter of 0.85 mm a number of times (85 times). Also, a voltage of 220V is applied to the degaussing coils 42 and 44, and a magnetomotive force of 2,900 AT (ampere turns) is realized.

TABLE 2

| No | D1 (mm) | D2 (mm) | D2/D1 | EW (μm) | NS (μm) | EW + NS (μm) |
|---|---|---|---|---|---|---|
| 1 | 150 | 170 | 0.88 | 51 | 12 | 63 |
| 2 | 150 | 200 | 0.75 | 58.5 | 9 | 67.5 |
| 3 | 150 | 230 | 0.65 | 86.5 | 23.25 | 109.75 |
| 4 | 150 | 270 | 0.55 | 99.75 | 31.25 | 131 |
| 5 | | | | 91 | 31.75 | 122.75 |

In Table 2, the distance D2 between the second coils 42*b* and 42B is increased from a reference length (e.g., 170 mm), and the changes in the landing of the electron beams is measured at each varied length of the distance D2 (No. 1~No. 4). As shown in the table, the distance D1 between the long edges 240*a* of the long side walls 24*a* of the inner shield 24 is maintained at 150 mm.

Further, EW, NS, and EW+NS represent the same values as described with reference to Table 1. Entry no. 5 is a comparative example of an embodiment, in which a conventional CRT utilizing M-shaped degaussing coils as described in the Background of the Invention is used to obtain data for comparison.

As is evident from Tables 1 and 2, when the degaussing coils 42 and 44 correspond to the shape of the long edges 240*a* of the inner shield 24, and the ratio D2/D1 is maintained between 0.7 and 1.3 (Entry nos. 1–5 in Table 1 and Entry nos. 1 and 2 in Table 2), the effectiveness of demagnetization is improved over the prior art.

In this embodiment of the present invention, the distance D1 is the minimum distance between the long edges 240*a*, and the distance D2 is the minimum distance between the second coils 42*b* and 44*b*.

Figure 4:
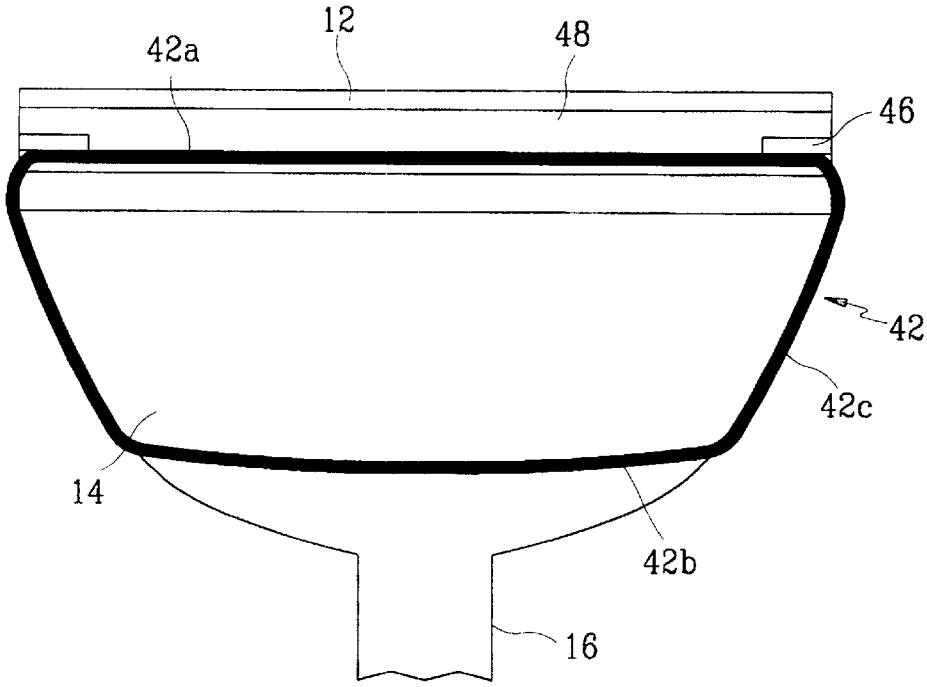
FIG. 4 is a partial plan view of the cathode ray tube of FIG. 1 to which a degaussing coil is mounted.

With reference to FIG. 4, the first coils 42*a* and 44*a* respectively of the degaussing coils 42 and 44 are positioned farther from the front face of the panel 12 than ears 46, which are formed on each corner of the panel 12. The first coils 42*a* and 44*a* and the ears 46 are formed over an explosion proof band 48, which is formed around a circumference of the panel 12.

The first coils 42*a* and 44*a* are positioned as described above since a magnetic flux density may be more effectively supplied to the inner shield 24 than when the first coils 42*a* and 44*a* are mounted behind the explosion proof band 48, that is, between the explosion proof band 48 and where the panel 12 and funnel 14 are fused. As a result, demagnetizing is better realized.

Another embodiment of the present invention will now be described with reference to FIGS. 5 and 6.

Figure 5:
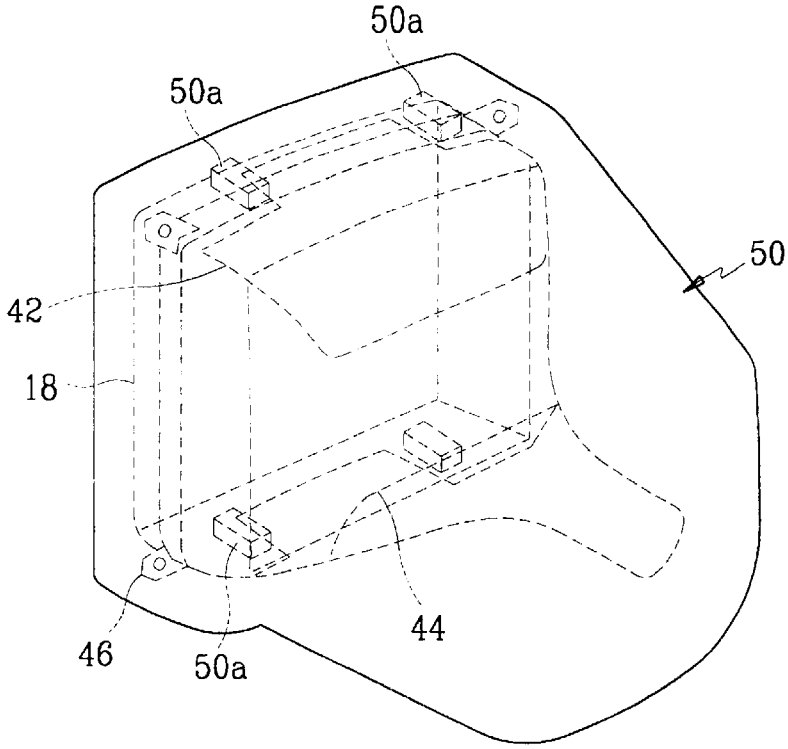
FIG. 5 is a schematic perspective view of a cathode ray tube according to a second embodiment of the present invention in a state where the cathode ray tube is mounted in a housing.
Figure 6:
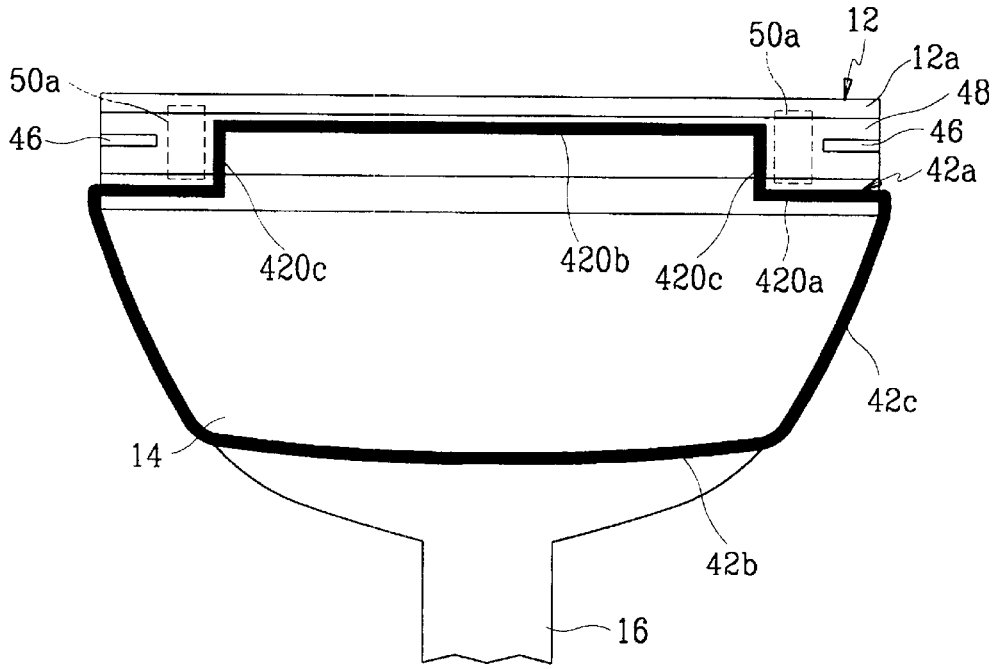
FIG. 6 is a partial plan view of the cathode ray of FIG. 5 to which a degaussing coil is mounted.

FIG. 5 is a schematic perspective view of a cathode ray tube according to an embodiment of the present invention in a state where the cathode ray tube is mounted in a housing, and FIG. 6 is a partial plan view of the cathode ray of FIG. 5 to which a degaussing coil is mounted. The housing 50 is formed by plastic injection molding. The same reference numerals will be used for elements identical to those of the previous embodiment of the present invention.

In the CRT according to this embodiment of the present invention, the degaussing coils 42 and 44 are mounted to the tube 18 basically in the same manner as in the previous embodiment of the present invention. However, the configuration described below is used in this embodiment so that favorable results are obtained with respect to the mounting of the CRT in the housing 50.

A plurality of supports 50*a* are mounted on the explosion proof band 48. The supports 50*a* protrude outwardly toward an inner surface of the housing 50. If the first coils 42*a* and 44*a* respectively of the degaussing coils 42 and 44 are positioned on the explosion proof band 48 as in the previous embodiment, the first coils 42*a* and 44*a* and the supports 50*a* overlap such that problems occur with the mounting of the CRT in the housing 50.

To prevent this problem in this embodiment, the first coils 42*a* include first sub coils 420*a* mounted on the skirt 12*a* of the panel 12 distanced farther from the front face of the panel 12 than the explosion proof band 48, second sub coils 420*b* mounted on the explosions proof band 48 at a position closer to the front face of the panel 12 than the ears 46, and third sub coils 420*c* for interconnecting the first sub coils 420*a* and the second sub coils 420*b*.

For convenience, only one of the two degaussing coils 42 and 44 is shown in FIG. 6. However, it is to be assumed that the degaussing coil 44 is configured identically to the degaussing coil 42 that appears in FIG. 6.

With the above structure, the degaussing coils 42 and 44 may be mounted toward the panel 12 without any overlapping of the first coils 42*a* and 44*a* and the supports 52*a*. As a result, the mounting of the CRT within the housing 50 may be more easily performed.

Figure 7:
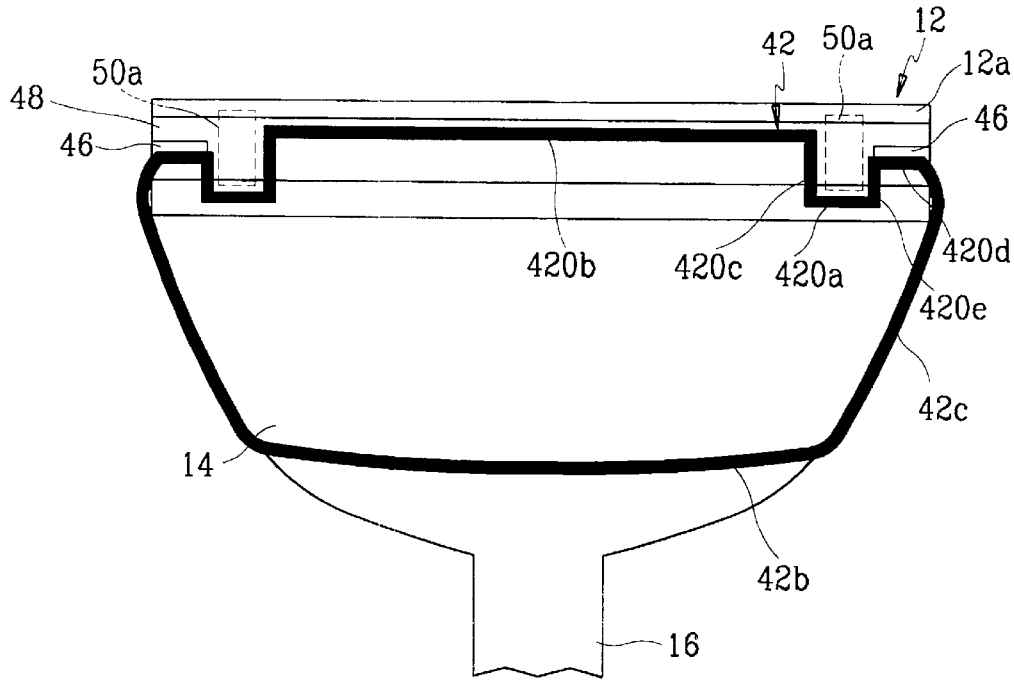
FIG. 7 is a partial plan view of a modified example of the cathode ray tube of the second embodiment of the present invention.

FIG. 7 is a partial plan view of a modified example of the cathode ray tube of the second embodiment of the present invention.

As shown in FIG. 7, the degaussing coil 42 has the same basic structure as in the second embodiment. However, the first coil 42*a* further includes a fourth sub coil 420*d* that is mounted on the explosion proof band 48 at a position farther from the front face of the panel 12 than the ears 46, and a fifth sub coil 420*e* that interconnects the fourth sub coil 420*d* and the first sub coil 420*a*. Again, only one of the two degaussing coils 42 and 44 is shown in the drawing, that is, in FIG. 6. However, it is to be assumed that the degaussing coil 44 is configured identically to the degaussing coil 42 that appears in FIG. 7.

With the above modified structure of the degaussing coil 42, a configuration is used to prevent the overlapping of the first coil 42*a* with the supports 50*a*. That is, the firs sub coil 420*a*, the third sub coil 420*c*, and the fifth sub coil 420*e* partly surround the supports 50*a*, and the fourth sub coil 420*d* is mounted on the explosion proof band 48 toward the ears 46. Such a structure also increases the demagnetizing effectiveness of the degaussing coil 42.

Although certain embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A cathode ray tube comprising:

a tube including a panel, a funnel, and a neck;

a color selection apparatus mounted to the panel within the tube;

an inner shield within the tube connected to the color selection apparatus and including a plurality of side walls that form a center opening through which electron beams pass; and at least one degaussing coil mounted at an outer surface of the tube, wherein the degaussing coil comprises:

a first coil mounted toward the panel;

a second coil mounted toward the neck; and a third coil connected to ends of the first coil and ends of the second coil to interconnect the first coil and the second coil, wherein the second coil is mounted on a side wall of the inner shield within the tube in a position substantially overlapping distal edge portions of the side walls of the inner shield on which the second coil is mounted.

2. The cathode ray tube of claim 1, wherein if a length of the distal edge portions of the side walls of the inner shield on which the second coil is mounted is L1 and a length of the second coil is L2, the following condition is satisfied:

$$L1 \leqq L2.$$

3. The cathode ray tube of claim 1, wherein degaussing coils are spaced apart and mounted at opposing positions on an outer surface of the tube.

4. The cathode ray tube of claim 3, wherein degaussing coils are deposited as a pair on the outer surface of the tube.

5. The cathode ray tube of claim 4, wherein if a distance between the distal edge portions of the side walls of the inner shield is D1, and a distance between second coil is D2, the following condition is satisfied:

$$0.7 \leqq (D2/D1) \leqq 1.3.$$

6. The cathode ray tube of claim 5, wherein the distances D1 and D2 are minimal lengths.

7. The cathode ray tube of claim 4, wherein the pair of degaussing coils are identical in shape and are deposited on the outer surface of the tube.

8. The cathode ray tube of claim 4, wherein the pair of degaussing coils are deposited symmetrically with respect to the neck on the outer surface of the tube.

9. The cathode ray tube of claim 1, wherein the second coil is formed along substantially identical horizontal lines as the distal edge portions of the side wall on which the second coil is mounted.

10. The cathode ray tube of claim 1, wherein the color selection apparatus comprises:

a mask frame including two pairs of support members, the support members of each pair being provided at a predetermined distance from each other, and a pair of elastic members, each of which extends to interconnect the support members comprising each pair of the same; and a mask having a plurality of apertures, wherein the support members of the mask frame being connected to the mask.

11. The cathode ray tube of claim 10, wherein the mask is mounted in a position such that to receive tension in a direction corresponding to a short side of the panel.

12. The cathode ray tube of claim 1, wherein an explosion proof band having a plurality of ears is mounted on the skirt of the panel, and the first coil is mounted on the explosion proof band positioned farther from a front face of the panel than the ears.

13. The cathode ray tube of claim 1, wherein the panel includes a skirt and an explosion proof band having a plurality of ears is mounted on the skirt of the panel, and the first coil comprises:

a first sub coil mounted on the skirt of the panel at a position farther from a front face of the panel than the explosion proof band;

a second sub coil mounted on the explosion proof band at a position closer to the front face of the panel than the plurality of ears; and a third sub coil interconnecting the first sub coil and the second sub coil.

14. The cathode ray tube of claim 13, wherein the first coil further comprises:

a fourth sub coil mounted on the explosion proof band at a position farther from the front face of the panel than the plurality of ears; and a fifth sub coil interconnecting the fourth sub coil and the first sub coil.

* * * * *